US006681678B2

(12) United States Patent
Eriksson

(10) Patent No.: US 6,681,678 B2
(45) Date of Patent: Jan. 27, 2004

(54) REVOLVING AMMUNITION MAGAZINE

(75) Inventor: Bengt Eriksson, Ornskoldsvik (SE)

(73) Assignee: Alvis Hagglunds Aktiebolag, Ornskoldsvik (CH)

( * ) Notice: Subject to any disclaimer, the term of this patent is extended or adjusted under 35 U.S.C. 154(b) by 0 days.

(21) Appl. No.: 10/204,190

(22) PCT Filed: Feb. 15, 2001

(86) PCT No.: PCT/SE01/00324

§ 371 (c)(1),
(2), (4) Date: Aug. 19, 2002

(87) PCT Pub. No.: WO01/61267

PCT Pub. Date: Aug. 23, 2001

(65) Prior Publication Data

US 2003/0075038 A1 Apr. 24, 2003

(30) Foreign Application Priority Data

Feb. 18, 2000 (SE) ..... 0000534

(51) Int. Cl.[7] ..... F41A 9/26
(52) U.S. Cl. ..... 89/34; 89/33.02; 89/33.1
(58) Field of Search ..... 89/33.02, 34, 45, 89/46, 33.1

(56) References Cited

U.S. PATENT DOCUMENTS 2,615,369 A * 10/1952 Jansson et al. ..... 89/33.02
3,376,785 A * 4/1968 Elwin ..... 89/46
4,495,853 A * 1/1985 Gottwaldt ..... 89/46
4,928,574 A * 5/1990 Golden ..... 89/34

FOREIGN PATENT DOCUMENTS

| | | | | |
|---|---|---|---|---|
| DE | DL 674 452 | * | 3/1939 | ..... 89/33.02 |
| DE | 2 051 355 | | 4/1972 | |
| GB | 371 316 | | 10/1930 | |
| SE | 217 868 | | 12/1967 | |

* cited by examiner

*Primary Examiner*—Stephen M. Johnson
(74) *Attorney, Agent, or Firm*—Young & Thompson

(57) ABSTRACT

A revolving ammunition magazine for shells, which has an number of elongate, first ammunition holder elements (14) which are distributed uniformly in relation to one another around a center axis (12) and designed and positioned so as to be capable of holding at least two shells (G1, G2) lying essentially parallel to and at a different radial distance from the center axis (12), and second ammunition holder elements **(14*a*, 14*b*, 16*b*, 18*b*) designed and arranged so as to be capable of holding at least one shell (G3) essentially parallel to the centre axis (12) and between the first ammunition holder elements (14) at the same radial distance from the center axis (12) as the radially outer shells (G1) in the first holder elements (14)**.

6 Claims, 5 Drawing Sheets

REVOLVING AMMUNITION MAGAZINE

BACKGROUND OF THE INVENTION

The present invention relates to a revolving ammunition magazine, in particular for shells, where the magazine comprises an ammunition holder unit which is mounted in a frame in a revolving manner around a longitudinal centre axis.

In connection with loading a shell-throwing weapon from the rear end of the barrel of the weapon, there is frequently a requirement for great storage capacity and thus compact design of the ammunition magazine when such weapons are mounted in mobile units in which the space is limited. Likewise, such shell magazines are to be capable of being coordinated with loading mechanisms for rear-loading of the weapon.

SUMMARY OF THE INVENTION

For this purpose, the revolving ammunition magazine according to the invention referred to in the introduction is characterized in that the ammunition holder unit comprises a number of elongate, first ammunition holder elements which are distributed uniformly in relation to one another around the centre axis and designed and positioned so as to be capable of holding at least two shells lying essentially parallel to and at a different radial distance from the centre axis, and second ammunition holder elements designed and arranged so as to be capable of holding at least one shell essentially parallel to the centre axis and between the first ammunition holder elements at the same radial distance from the centre axis as the radially outer shells in the first holder elements. By virtue of such a construction of the magazine, a large number of shells can be stored in a very limited area, it being possible for shells in a radially inner storage location in the first ammunition holder elements to be transferred automatically to a radially outer ejection position by gravitational force acting on them during the revolving motion of the magazine, when a radially outer shell in the same holder element has previously been ejected.

Further features and details of the ammunition magazine according to the invention are indicated in the dependent patent claims below and will be described in greater detail below.

In a particularly suitable arrangement of ammunition magazines according to the invention, two magazines are positioned in a mirror-inverted manner in relation to one another with a common ammunition ejector mechanism located between the magazines. As a result, a shell-throwing weapon can be coordinated with a very compact loading and magazine unit with great capacity.

BRIEF DESCRIPTION OF THE DRAWINGS

The invention is described in greater detail below with reference to the appended drawings, in which.

DESCRIPTION OF THE PREFERRED EMBODIMENTS

Figure 1:
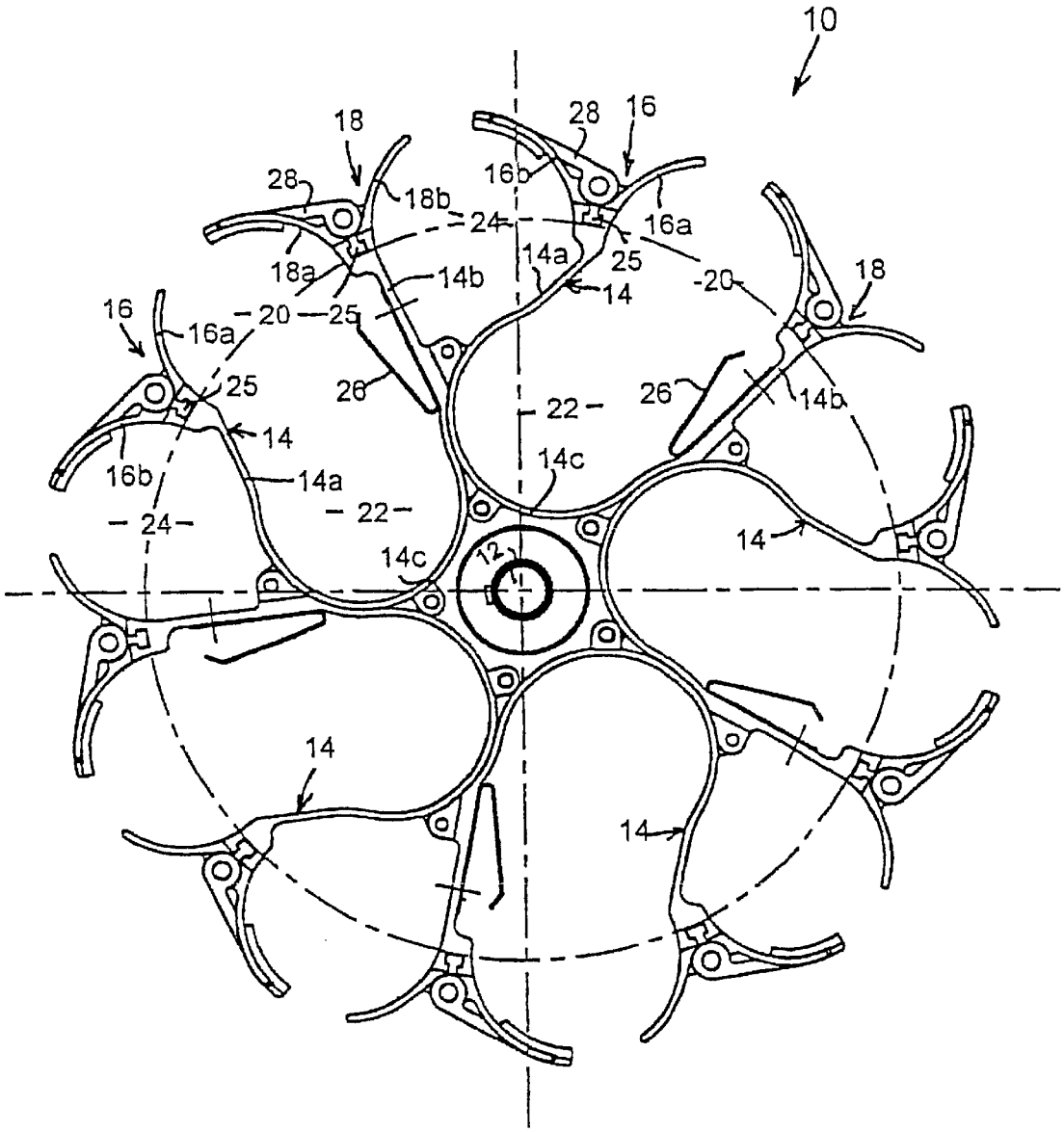
FIG. 1 is an end view of an empty ammunition holder unit for a revolving ammunition magazine according to the invention.
Figure 2:
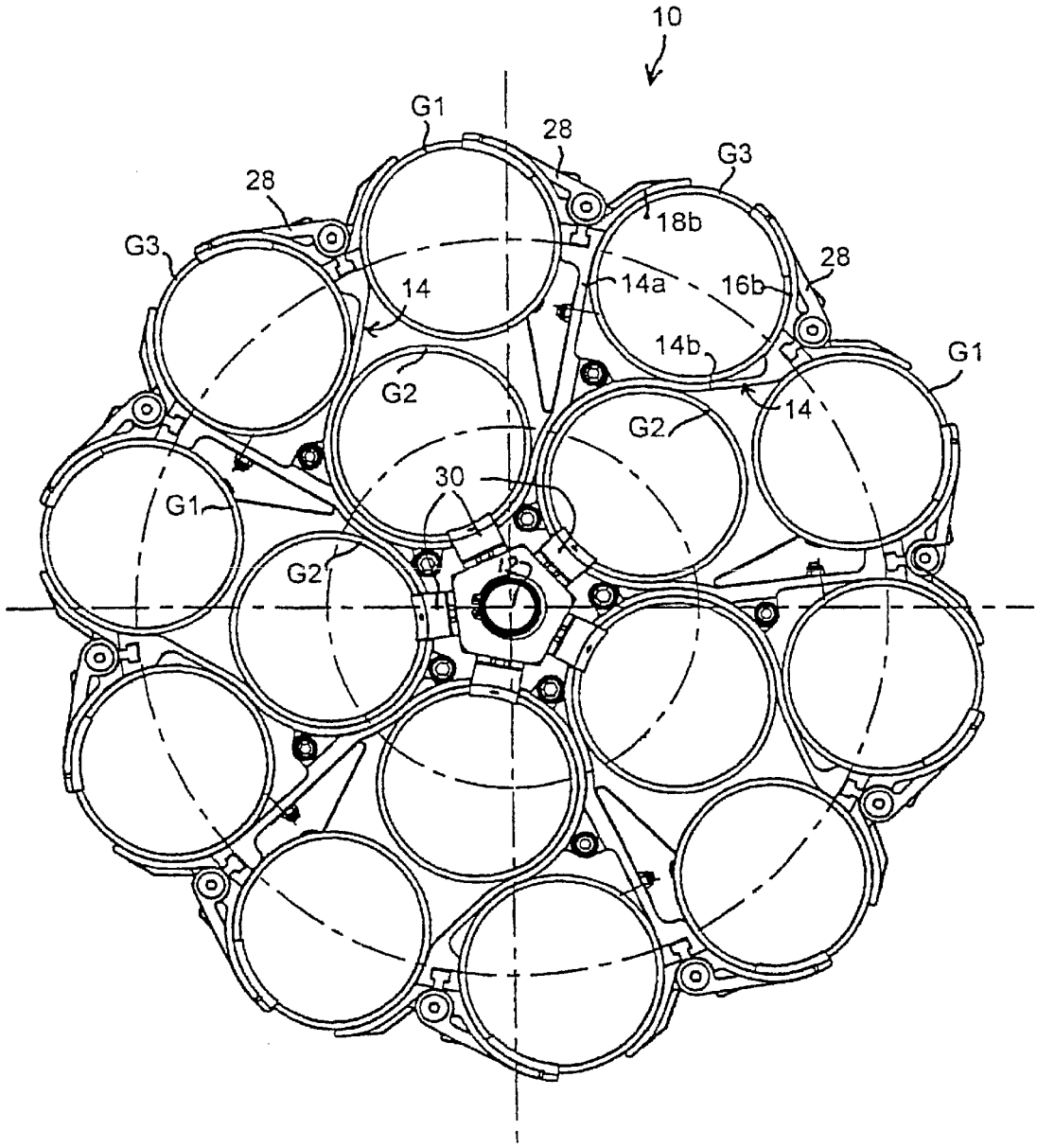
FIG. 2 is an end view similar to FIG. 1 of the holder unit filled with shells.
Figure 3:
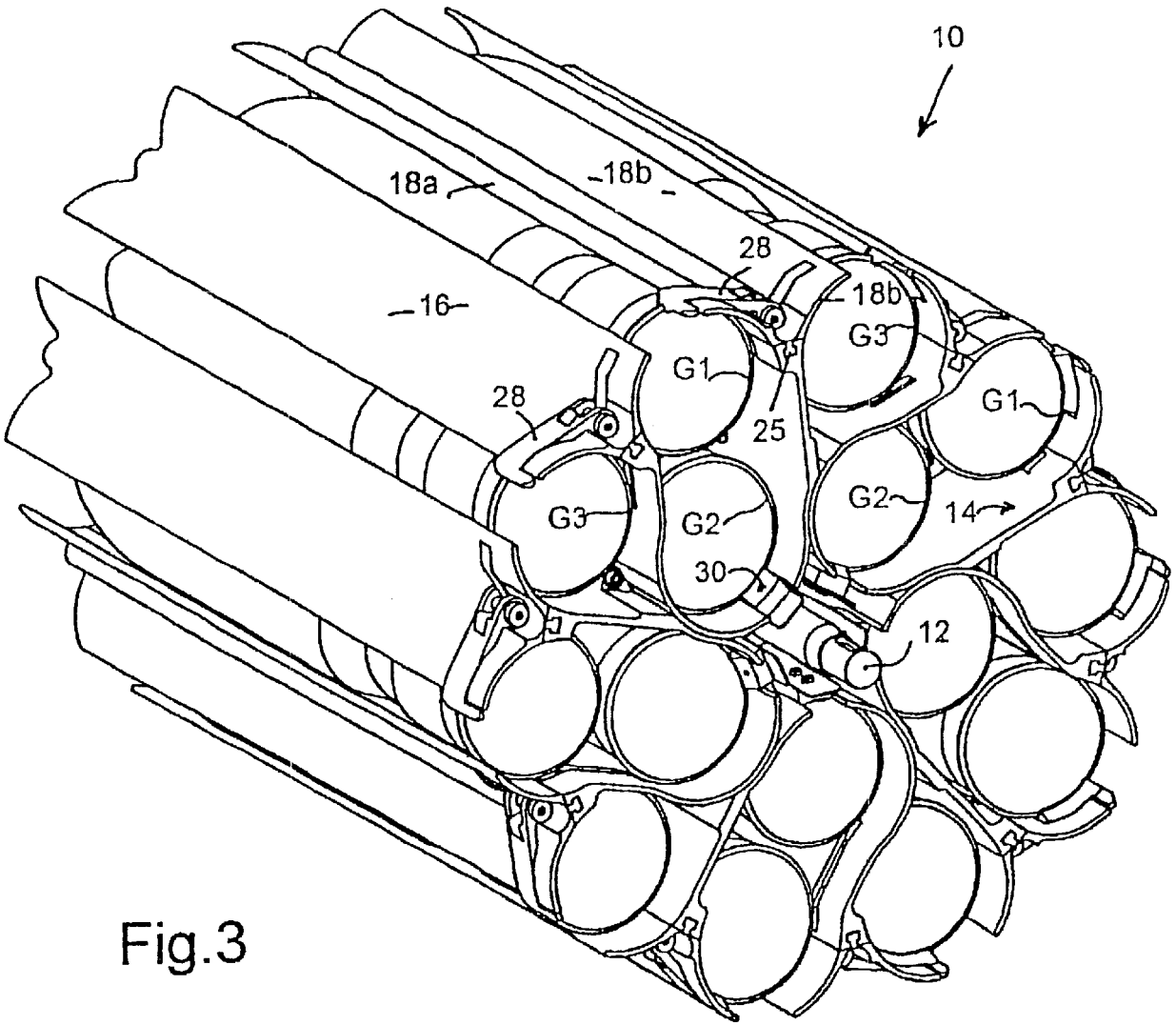
FIG. 3 is a fragmentary perspective view of the ammunition holder unit in FIG. 2.

In FIG. 1, 10 designates generally an ammunition holder unit for a revolving ammunition magazine for shells according to the invention. The holder unit 10 comprises five elongate shell holder elements 14 of fundamentally U-shaped cross section, which are distributed uniformly in the circumferential direction around a longitudinal centre axis 12 and which can each accommodate two shells G1 and G2 lying parallel to and at a different radial distance from the centre axis 12, as shown in FIGS. 2 and 3. Mounted at the outer ends of the legs 14*a*, 14*b* of the holder elements are curved wing elements 16 and, respectively, 18, an arcuate flange part 16*a* of the wing element 16 being directed towards a corresponding arcuate flange part 18*a* of the curved wing element 18 on the end of the leg 14*b*, so that the flange parts 16*a*, 18*a* directed towards one another partly bridge the distance between the leg ends and delimit a space 20 so as to be capable of securing a radially outer shell G1 in the holder element 14, while a radially inner arcuate web portion 14*c* of the holder 14 delimits a space 22 for securing a radially inner shell G2. The curved wing elements 16, 18 also have an arcuate flange part 16*b* and, respectively, 18*b*, which flange parts are directed towards one another in such a manner that they delimit, between two adjacent holder elements 14 and in interaction with the outside of the legs 14*a* and 14*b* of two adjacent holder elements 14, a space 24 for accommodating a shell G3 (FIGS. 2 and 3) at the same radial distance from the centre axis 12 as the shells G1 in the spaces 20 of the holder elements 14. In this way, the ammunition unit 10 can accommodate ten shells G1 and G3 in a radially outer storage location and five shells G2 in a radially inner storage location.

The wing elements 16, 18 can be arranged in a push-on manner on the outer end portion of the legs 14*a*, 14*b* by means of a dovetail-like connection 25.

Mounted on the inside of the legs 14*b* is an essentially V-shaped plate spring element 26 which is arranged so as to yield and allow movement of a radially inner shell G2 in the space 22 to the radially outer space 20, when the latter has previously been emptied of its shell G1 and when the shell G2 is acted on by gravity during the revolving motion of the ammunition holder unit 10 and thus drops down into the space 20. The plate spring element 26 then springs back out and prevents the now outer shell from dropping back into the now empty, radially inner space 22.

Locking means in the form of pivotable locking latches 28 at a rear end of the wing elements 16, 18 can detachably fix the shells axially in the outer spaces 20, 24 by engagement with a rear portion of the shells, while locking elements 30 can detachably secure the shells axially in the radially inner spaces 22 likewise by engagement with a rear portion of the shells.

In a preferred embodiment of an ammunition magazine M according to the invention, the ammunition holder unit 10 described above is, as shown in FIGS. 4 and 5, mounted in a revolving manner in a respective frame 32 which includes two frame sidepieces 32*a*, 32*b* and upper and lower angle stays 34 at one, inner delimiting side of the magazine M. On the opposite, outer delimiting side of the magazine M, the frame sidepieces 32*a*, 32*b* can also be interconnected and braced by a number of tubular elements 36 which can at the same time constitute stationary holding space for further shells (seven in the example shown).

The rear frame sidepiece 32*a* has a triangular cutout 38 which opens in the inner delimiting side of the magazine M and which is designed so as to expose two of the radially outer spaces 20, 24 for shells G1 and G3 and one inner space 22 for shells G2, so that empty such spaces in the magazine can be reloaded with new shells from the rear. It is also possible to conceive of loading the magazine M from an opening in the front frame sidepiece 32*b,* in which case the opening can expose the radially inner space 22 of the holder element 14 at the same time as the outer space 20 (the ejection position P in FIG. 4).

In the example shown in the drawings, the ammunition holder unit 10 can be revolved in steps of 36° by means of an electric motor 40 which, via gearwheels 42, 44 and a chain 46, revolves the unit 10 around the centre axis 12. An adjustable chain-tensioning wheel 48 keeps the chain 46 tensioned as necessary.

Figure 4:
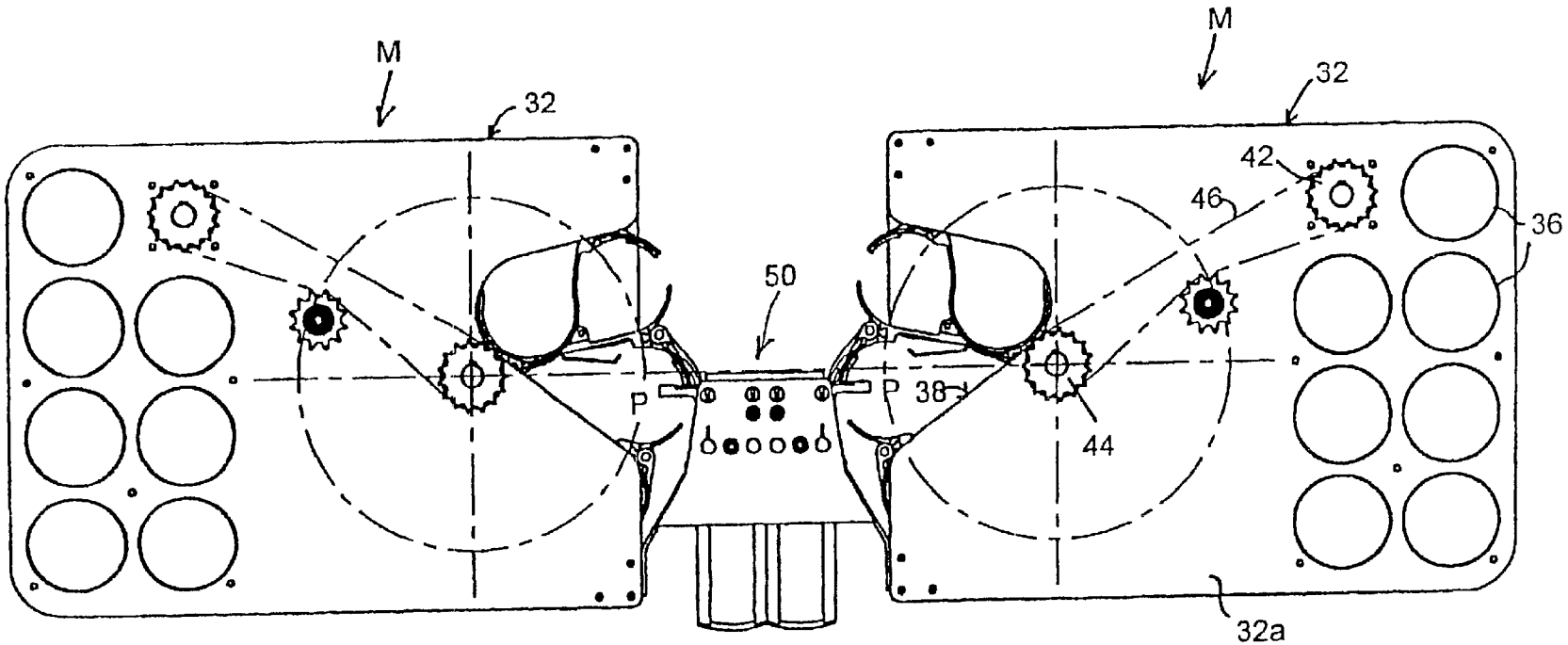
FIG. 4 is an end view from the rear of two revolving magazines mounted in a mirror-inverted manner, which each have an ammunition holder unit mounted in a revolving manner in a respective magazine frame, a shell ejector mechanism being arranged between the magazines.
Figure 5:
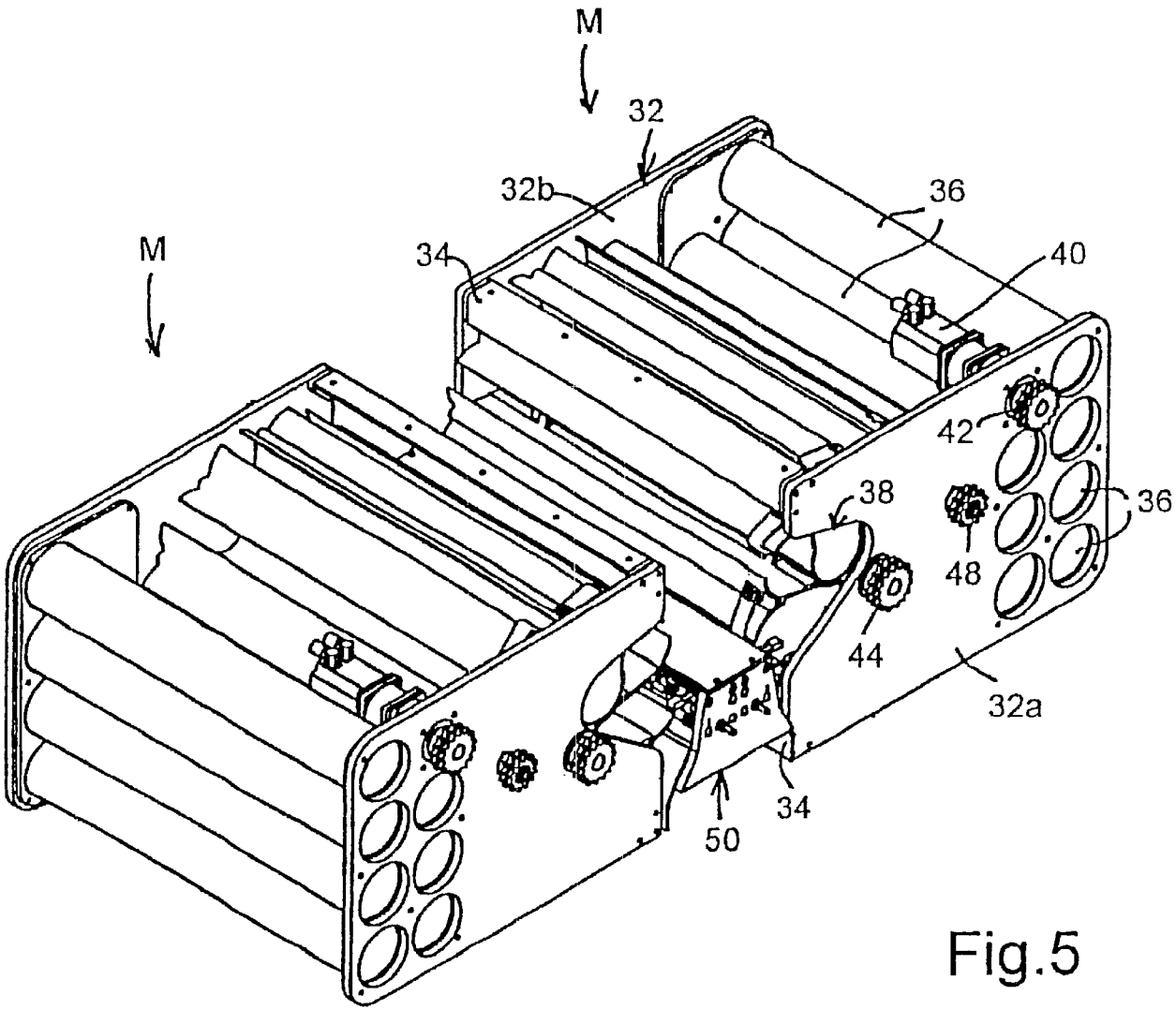
FIG. 5 is a perspective view of the arrangement in FIG. 4.

In FIGS. 4 and 5, two magazines M of the type described above are arranged side by side in a mirror-inverted manner, a shell ejector unit 50 (not described in greater detail) being arranged between the magazines M for individual ejection of shells in the respective positions P in the magazines to a loading tray (not shown) or all the way into the rear end of an associated weapon barrel. By virtue of such a twin arrangement of revolving magazines M with a common ejector unit 50, a double-barrelled weapon can be stocked with at least 44 shells in a very limited space in a vehicle.

Although the embodiment of the revolving ammunition holder unit 10 shown and described is designed to accommodate shells in two radially separate storage locations, it is possible within the scope of the present invention to design shell holder elements in a similar manner so that several radially separate storage locations for shells can be accommodated therein, an even greater capacity then being achieved.

What is claimed is:

1. A revolving ammunition magazine for holding shells, comprising:

an ammunition holding unit rotatably mounted in a frame around a longitudinal axis, said ammunition holding unit comprising, plural first ammunition holder elements uniformly distributed around said longitudinal axis, each of said first ammunition holder elements being arranged and adapted to hold two shells essentially parallel to said longitudinal axis spaced at different radial distances from said longitudinal axis, each of said first ammunition holder elements having an essentially U-shaped cross section with free leg ends thereof having first arcuate flanges that are directed towards each other and at least partially bridging a distance between said free leg ends, and second ammunition holder elements that are each between a respective adjacent pair of said first ammunition holder elements and that are arranged and adapted to hold a shell essentially parallel to said longitudinal axis and at a same radial distance from said longitudinal axis as radially outer shells held in said respective adjacent pair of said first ammunition holder elements.

2. The magazine of claim 1, wherein each of said second ammunition holder elements comprises second arcuate flanges that are directed towards each other at respective ones of said free leg ends of adjacent said first ammunition holder elements and at least partially bridging a distance between said free leg ends of said adjacent first ammunition holder elements.

3. The magazine of claim 2, wherein one of said first arcuate flanges and one of said second arcuate flanges extend from each of said free leg ends and are continuously connected to each other.

4. The magazine of claim 3, wherein said one first arcuate flange and said one second arcuate flange that are continuously connected to each other are connected to a respective one of said free leg ends with a dove-tail connection.

5. The magazine of claim 1, wherein each of said first ammunition holder elements having an essentially U-shaped cross section comprises a spring projecting into said U-shaped cross section, said spring preventing radially inward movement of a shell and permitting radially outward movement of a shell.

6. The magazine of claim 5, wherein said spring comprises an elongate, essentially V-shaped plate spring.

* * * * *